United States Patent [19]

Muzeroll et al.

[11] Patent Number: 4,488,091

[45] Date of Patent: Dec. 11, 1984

[54] HIGH INTENSITY DISCHARGE LAMP

[75] Inventors: Martin E. Muzeroll, Merrimack, N.H.; Robert Bonazoli, Hamilton; John F. Waymouth, Marblehead, both of Mass.; Robert J. Karlotski, Weare, N.H.

[73] Assignee: GTE Products Corporation, Stamford, Conn.

[21] Appl. No.: 440,907

[22] Filed: Nov. 12, 1982

[51] Int. Cl.[3] ..... H05B 41/16

[52] U.S. Cl. ..... 315/268; 315/60; 315/272; 315/275; 315/349

[58] Field of Search ..... 315/60, 47, 268, 272, 315/275, 349

[56] References Cited

U.S. PATENT DOCUMENTS

| | | | |
|---|---|---|---|
| 3,619,711 | 11/1971 | Freese | 315/60 |
| 4,029,989 | 6/1977 | Fellows | 315/60 |
| 4,097,777 | 6/1978 | Bacharowski | 315/60 |
| 4,322,658 | 3/1982 | Minarczyk | 315/47 |

*Primary Examiner*—Harold Dixon

*Attorney, Agent, or Firm*—Thomas H. Buffton

[57] ABSTRACT

A high intensity discharge lamp operable from an AC potential source includes an arc discharge tube having a pair of oppositely disposed main electrodes therein and an associated external starting electrode, all disposed within a sealed envelope having an affixed base with a circuit means including a negative potential blocking device coupling the starting electrode to the AC potential source.

8 Claims, 6 Drawing Figures

FIG.

HIGH INTENSITY DISCHARGE LAMP

TECHNICAL FIELD

This invention relates to high intensity discharge lamps and more particularly to high intensity discharge lamps having a starting probe energized by a positive-going portion of an AC potential source.

BACKGROUND ART

High intensity discharge lamps normally include an arc discharge tube having a fill of sodium, mercury, and an inert gas with an electrode sealed into opposite ends thereof. This arc discharge tube is sealed within an outer envelope which ordinarily has an attached base formed to connect to an energizing source. Moreover, it is known that high intensity discharge lamps require a higher starting voltage than an ordinary low pressure lamp.

One known technique for starting high intensity discharge lamps includes the utilization of a special high voltage producing ballast apparatus. Another known technique is to embed a starting electrode in one end of the arc tube and to position the starting electrode adjacent one of the electrodes of the arc tube. However, special high voltage ballast apparatus undesirably adds to the cost of the light source. Also, starting electrodes sealed into one end of the arc tube tend to develop an accumulation of condensed metal halide salts which leads to undesired electrolysis at or near the main electrode and failure of the arc tube seal.

Another arrangement for starting high intensity discharge lamps is set forth in U.S. Pat. No. 4,322,658 issued to Minarczyk on Mar. 30, 1982. Therein, an arc tube having an electrode sealed into each end is positioned within an outer sealed envelope. The electrodes of the arc tube are embedded in a support as is a starting probe which is positioned immediately adjacent the arc tube. A base is affixed to the outer sealed envelope and formed for connection to an AC potential source while an electronic pulsing circuit is located within the base. The pulsing circuit provides a pulse potential during the positive and negative half-cycle of the applied AC potential and these positive and negative pulse potentials are applied to the starting probe until a discharge is established within the lamp. Thereafter, application of the positive and negative pulse potentials to the starting probe is discontinued.

Although the above-described apparatus has been employed with varying degrees of success, it has been found that certain disadvantages do exist and such apparatus does leave something to be desired. More specifically, it is known that the appearance of a negative potential, such as the negative half-cycle of an AC potential, on a starting electrode or probe associated with a discharge lamp which includes sodium tends to cause not only sodium loss from the lamp but undesired electrolysis as well.

As set forth on Pages 266–269 of a book entitled "Electric Discharge Lamps" by John F. Waymouth, M. I. T. Press 1971, an arc lamp having a fill which includes sodium tends to exhibit sodium loss whenever a negative potential appears in the vicinity of the external surface of the arc discharge tube. Briefly, the probe adjacent the arc tube receives a strong flux of ultraviolet light from the arc tube which causes photoelectron emission. Also, the surface of the arc tube tends toward a positive charge which attracts the photoelectrons caused by the negative potential on the probe. Moreover, the photoelectrons accumulating on the outer surface of the arc tube undesirably attract the sodium ions which pass through the arc tube and combine with the photoelectrons. Thus, sodium loss as well as electrolysis deleteriously affect the discharge lamp.

One approach suggesting a technique for reducing sodium loss in a discharge lamp is set forth in U.S. Pat. No. 4,281,274 issued to Bechard et al on July 28, 1981. Therein, a glass sleeve surrounds the arc tube and is connected to a potential which is positive relative to the arc tube. Thus, the glass sleeve acts as a shield trapping ultraviolet light. However, such structures obviously tend to increase cost while reducing manufacturing efficiency.

Known approaches attempting to reduce the above-described undesirable results are also illustrated in the prior art FIGS. 1, 2, and 3. In FIG. 1, a positive coefficient resistor "R", capacitor "C" and thermal protector "T" are series connected across an AC potential source. A glow bottle "G" and the primary of a transformer shunt the capacitor "C" while the transformer secondary is coupled to a starting probe. Similarly FIG. 2 has a positive coeffiecient resistor R and a combined overvoltage and thermal protector series connected and coupled across an AC potential source. A capacitor C and a transformer primary winding shunt the thermal protector with the transformer secondary coupled to a starting probe. However, in both examples, FIGS. 1 and 2, a negative-going half-cycle of the AC potential source is applied to the starting probe causing the above-described undesired sodium loss and electrolysis development.

Additionally, it has been found that rearrangement of circuitry components does little or no good in so far as alterations in probe potential is concerned. For example, FIG. 3 illustrates a configuration wherein a resistor "R", capacitor "C" and thermal switch "T" are series connected across an AC potential source; a spark gap and transformer primary winding are shunted across the capacitor "C" and the transformer secondary is coupled to a starting probe. However, it is clear that the negative half-cycle of an AC potential source will still undesirably appear at the starting probe causing undesired sodium loss and electrolysis.

OBJECTS AND SUMMARY OF THE INVENTION

An object of the present invention is to provide an enhanced metal halide discharge lamp. Another object of the invention is to improve the operational capabilities of a metal halide discharge lamp. Still another object of the invention is to provide an inexpensive compact metal halide discharge lamp with an extended useful life capability. A further object of the invention is to provide an improved metal halide discharge lamp which obviates the above-described difficulties found in prior known structure.

These and other objects, advantages and capabilities are achieved in one aspect of the invention by a metal vapor discharge lamp having a sealed arc tube contained within an outer jacket affixed to a base member. The sealed arc tube has an electrode sealed into each of the opposite ends thereof and a starting probe is positioned adjacent the arc tube. Importantly, circuitry which includes a negative-potential blocking means is employed to couple an AC potential source to the electrodes of the arc tube.

In another aspect of the invention, a gaseous filled arc tube having an electrode sealed in opposite ends and a starting electrode adjacent thereto is sealed within an envelope having a base member affixed thereto and a circuit means including a unidirectional conduction device is located within the base members and couples an AC potential source to the electrodes sealed into the arc tube.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
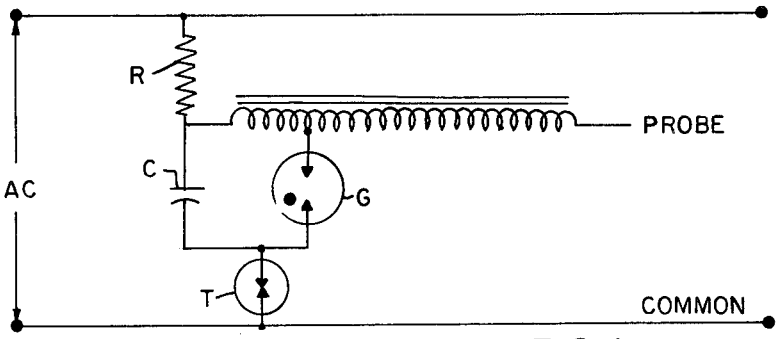
FIG. 1 PRIOR ART
FIGS. 1, 2, and 3 illustrate prior art circuitry embodiments utilized in attempting to reduce sodium loss in discharge lamps.
Figure 2:
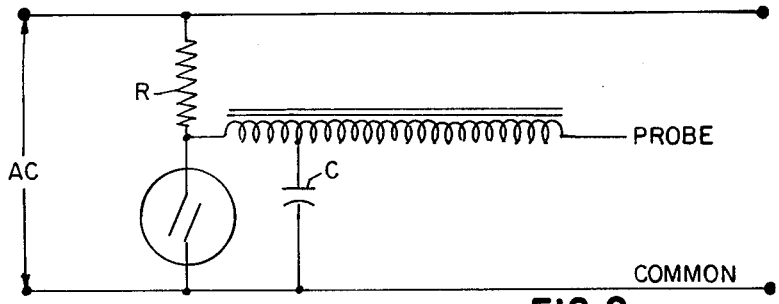
FIG. 2 PRIOR ART
Figure 3:
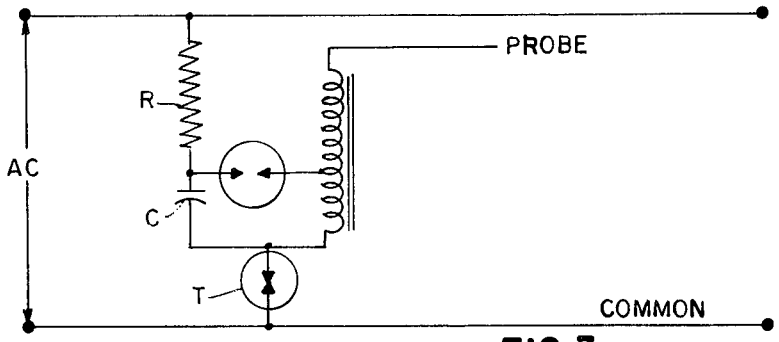
FIG. 3 PRIOR ART
Figure 4:
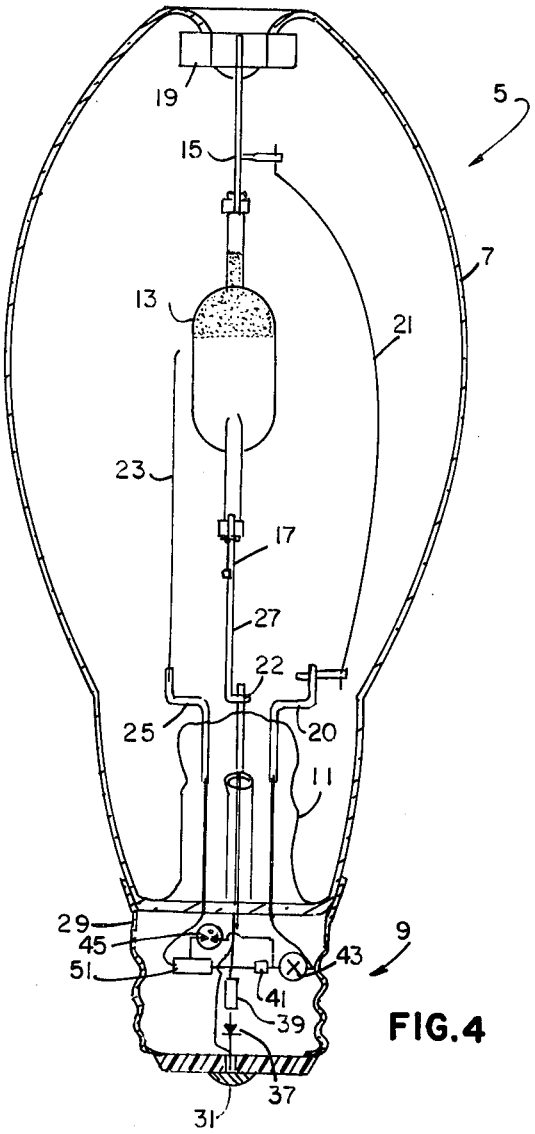
FIG. 4 is an elevational view, partly broken away, of a metal vapor discharge lamp of the invention.
Figure 5:
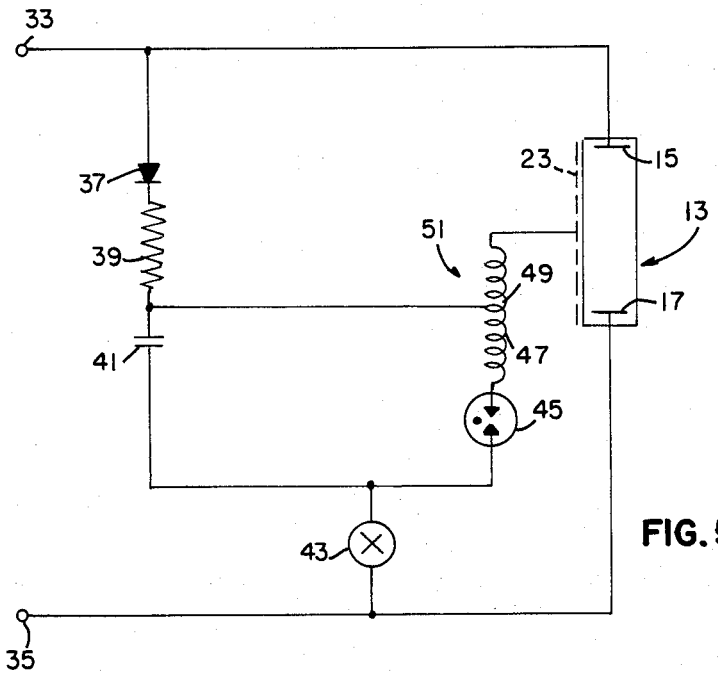
FIG. 5 is a diagrammatic illustration of the electrical circuitry associated with the lamp of FIG. 4.

Referring to the drawings, FIGS. 4 and 5 are illustrative of a preferred form of metal halide discharge lamps operable from an AC potential source. Herein, a metal halide discharge lamp 5 includes a hermetically sealed outer glass envelope 7 having a screw-in type base 9 affixed thereto. A glass stem support member 11 is attached to and extends inwardly of the outer glass envelope 7.

Disposed within the outer glass envelope 7 is an arc discharge tube 13. The arc discharge tube 13 includes a pair of main electrodes 15 and 17 disposed at opposite ends thereof. One of the main electrodes 15 is connected to a fixture 19 which contacts the outer glass envelope 7 to provide support for the arc discharge tube 13. The one main electrode 15 is connected to an electrical conductor 21 which also is affixed to a conductor 20 which passes through the glass stem support member 11. The other main electrode 17 is connected to an electrical conductor 22 passing through the glass stem support member 11. A starting electrode 23 is placed within close proximity of the outer surface of the arc discharge tube 13 and connected to an electrical conductor 25 supported by and passing through the glass stem support member 11.

The affixed base 9 has an outer threaded portion 29 and a center contact 31. The outer threaded portion 29 is electrically connected to the one main electrode 15 by way of the electrical conductor 21, while the center contact 31 is electrically connected to the other main electrode 17 by way of the electrical conductor 22. Also, the threaded portion 29 and the center contact 31 are formed for electrical contact with a pair of terminals 33 and 35 (FIG. 5) connectable to an AC potential source.

Preferably, a circuit means is disposed within the base 9 and intermediate thereto and the hermetically sealed outer envelope 7. Therein is provided a negative-potential blocking means illustrated as a unidirectional conduction device or diode 37. This diode 37 is in series-connection with a resistor 39, a charge storage means or capacitor 41 and a terminal protection means 43, all of which are shunted across the terminals 33 and 35 connectable to an AC potential source and the main electrodes 15 and 17 of the arc discharge tube 13. Also, a surge arrester 45 and the primary and secondary windings 47 and 49 of a transformer 51 are series-connected to the starting electrode 23 with the surge arrester 45 and primary winding 47 shunted across the capacitor 41.

In operation, the diode 37 responds to a positive potential from an AC potential source to charge the capacitor 41 by way of the current-limiting resistor 39. When the capacitor 41 reaches a charge state in excess of the break-over voltage of the surge arrester 45, the capacitor 41 is abruptly discharged via the primary winding 47 of the transformer 51. This produces a high voltage pulse potential at the secondary winding 49 and at the starting electrode 23 with respect to the main electrode 17. Also, failure of the arc discharge tube 13 to ignite is followed by repetition of the above-described sequence. Moreover, the diode 37 serves as a blocking means for negative potentials available from the AC potential source.

Figure 6:
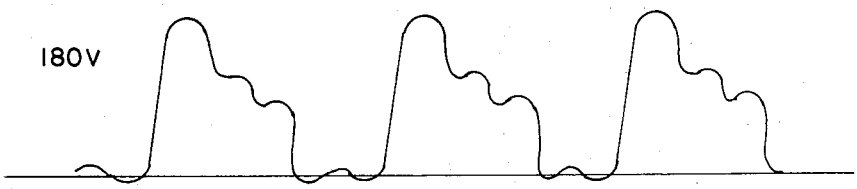
FIG. 6 is a graphic illustration of the potential available at the starting electrode or probe of the metal vapor discharge lamp of FIG. 4.

As illustrated graphically in FIG. 6, the included diode 37 serves to prevent the negative-going half-cycle of the AC potential source from developing a negative-going pulse potential for application to the starting probe or electrode 23. As a result, a positive-going pulse potential is applied to the starting probe until conductivity of the discharge lamp is effected. Thereupon, the positive-going half-cycle of the AC potential, illustrated in FIG. 6, is applied during stabilized lamp operation. Moreover, it has been found that elimination of the application of the negative-going half-cycle of the AC potential to the probe has not adversely affected the operation of the discharge lamp.

Thus, there has been provided a metal halide discharge lamp having an arc discharge tube which includes a fill containing sodium and wherein undesired electrolysis or dispersion of the sodium is virtually eliminated. The incorporation of a negative-voltage blocking capability into a metal halide discharge lamp provides an enhanced and desired result at a minimum of additional cost.

While there has been shown and described what is at present considered the preferred embodiments of the invention, it will be obvious to those skilled in the art that various changes and modifications may be made therein without departing from the invention as defined by the appended claims.

We claim:

1. A high intensity discharge lamp operated from an associated AC potential source comprising:

a sealed outer envelope;

a sealed arc tube disposed within said envelope, said arc tube containing an arc sustaining fill gas and having an electrode sealed into each end thereof and passing through said outer envelope;

a starting probe positioned adjacent said arc tube and passing through said outer envelope;

a base member affixed to said outer envelope; and a circuit means including a series-connected unidirectional conduction device and capacitor shunting said AC potential source and said electrodes of said arc tube with said unidirectional conduction device connected to one side of said A.C. source and poled to provide conduction to said capacitor only on the positive going half cycle at said side, a series-connected surge arrestor and primary winding of a transformer shunting said capacitor with one electrode of the surge arrestor connected to the other side of the A.C. line, and a secondary winding of said transformer coupling said primary winding to said starting probe whereby photoelectric negative charging of said arc tube and ionic current flow therethrough is inhibited.

2. The high intensity discharge lamp of claim 1 wherein said circuit means is disposed within said base member.

3. The high intensity discharge lamp of claim 1 wherein said circuit means includes a series-connected unidirectional conduction device, resistor, and capacitor coupled to an AC potential source and to said electrodes of said arc tube, a series-connected transformer primary winding and surge arrester shunting said capacitor, and a transformer secondary winding coupled to said primary winding and to said starting probe.

4. The high intensity discharge lamp of claim 3 wherein said unidirectional conduction device is a diode.

5. The high intensity discharge lamp of claim 3 including a terminal production means coupled intermediate said series connected unidirectional conduction device, resistor and capacitor and one side of said AC potential source.

6. The high intensity discharge lamp of claim 3 wherein said base member is a screw-type base adapted for connection to an AC potential source.

7. A metal halide lamp operated from an AC potential source comprising:

an arc tube containing an arc sustaining gas fill and a pair of electrodes sealed into and extending outwardly therefrom;

a starting probe positioned adjacent an electrode of said arc tube;

an outer envelope enclosing said arc tube with said electrodes of said arc tube and said starting probe passing through;

a base member affixed to said outer envelope; and a circuit means disposed within said base member, said circuit means including a series-connected unidirectional conduction device, resistor and capacitor shunted across said AC potential source and said electrodes of said arc tube with said unidirectional conduction device connected to one side of said A.C. source and poled to provide conduction to said capacitor only on the positive going half cycle at said side, a surge arrestor and transformer primary winding series-connected and shunting said capacitor and a transformer secondary winding connected to said transformer primary winding and said starting probe wherein the surge arrestor has one end connected to the other side of the line.

8. The metal halide lamp of claim 7 including a terminal protection means coupling said capacitor and said surge arrester to one side of said AC potential source.

* * * * *